US007588476B2

(12) United States Patent
Hammond

(10) Patent No.: US 7,588,476 B2
(45) Date of Patent: Sep. 15, 2009

(54) HINGED CONNECTOR FOR MULTI-PART CONSTRUCTION TOY

(75) Inventor: Eric Hammond, Broomall, PA (US)

(73) Assignee: K'NEX Limited Partnership Group, Hatfield, PA (US)

( * ) Notice: Subject to any disclaimer, the term of this patent is extended or adjusted under 35 U.S.C. 154(b) by 867 days.

(21) Appl. No.: 11/101,894

(22) Filed: Apr. 8, 2005

(65) Prior Publication Data

US 2006/0228980 A1 Oct. 12, 2006

(51) Int. Cl.
*A63H 33/12* (2006.01)
*A63H 33/08* (2006.01)

(52) U.S. Cl. ..... 446/104; 446/126

(58) Field of Classification Search ..... 446/107, 446/109, 119–122, 124–128, 102, 104
See application file for complete search history.

(56) References Cited

U.S. PATENT DOCUMENTS

| | | | | | |
|---|---|---|---|---|---|
| 2,776,521 | A | * | 1/1957 | Zimmerman | 446/115 |
| 4,044,497 | A | | 8/1977 | Bettens | |
| 4,185,410 | A | * | 1/1980 | Kristiansen | 446/104 |
| 4,214,403 | A | * | 7/1980 | Knudsen | 446/104 |
| 4,253,268 | A | * | 3/1981 | Mayr | 446/104 |
| 4,302,900 | A | | 12/1981 | Rayner | |
| 4,606,732 | A | * | 8/1986 | Lyman | 446/120 |
| 4,738,648 | A | | 4/1988 | Berndt | |
| 4,764,144 | A | | 8/1988 | Lyman | |
| 4,787,191 | A | | 11/1988 | Shima | |
| 4,886,477 | A | * | 12/1989 | Ziegler | 446/104 |
| 5,049,104 | A | * | 9/1991 | Olsen | 446/104 |
| 5,061,219 | A | * | 10/1991 | Glickman | 446/126 |
| 5,137,486 | A | * | 8/1992 | Glickman | 446/126 |
| 5,199,919 | A | * | 4/1993 | Glickman | 446/126 |
| 5,209,693 | A | * | 5/1993 | Lyman | 446/104 |
| 5,350,331 | A | * | 9/1994 | Glickman | 446/126 |
| 5,545,070 | A | * | 8/1996 | Liu | 446/104 |
| 5,645,463 | A | * | 7/1997 | Olsen | 446/104 |
| 5,769,681 | A | * | 6/1998 | Greenwood et al. | 446/120 |

FOREIGN PATENT DOCUMENTS

| | | |
|---|---|---|
| GB | 524 300 | 8/1940 |

* cited by examiner

*Primary Examiner*—Gene Kim
*Assistant Examiner*—Alyssa M Hylinski
(74) *Attorney, Agent, or Firm*—St. Onge Steward Johnston & Reens LLC

(57) ABSTRACT

A connector element for a rod and connector construction toy set of the type enabling a lateral snap-in assembly of rod elements into sockets of the connector is formed of two hingedly connected connector half sections. Each connector half section is formed along one edge with one male and one female hinge element such that two identical connector half sections can be joined together, by a snap-together action of the hinge elements, to form a connector element with one half pivotally movable relative to the other half. Each connector half section is formed with a plurality of rod-engaging sockets accommodating the construction of complex, three-dimensional structures. Advantageously, the two connector half sections are of identical construction, such that both components may be formed of a single mold configuration.

12 Claims, 7 Drawing Sheets

HINGED CONNECTOR FOR MULTI-PART CONSTRUCTION TOY

RELATED CASES

The invention of this application is related to Joel I. Glickman U.S. Pat. Nos. 5,061,219, 5,137,486, 5,199,919, and 5,350,331. The disclosures of these patents are incorporated by reference.

BACKGROUND OF THE INVENTION

In the Glickman U.S. Pat. No. 5,061,219, there is disclosed a multi-part construction toy utilizing a novel form of rod and connector system which enables rods to be joined with connectors by a lateral, snap-in motion into sockets provided by the connector elements. In the subsequent Glickman U.S. Pat. Nos. 5,137,486 and 5,199,919, there are disclosed modified forms of connector elements in which two connector parts are joined together in a fixed relation, with one connector part being in a plane oriented at right angles to the plane of the other connector part. The resulting connector enables rods to be assembled in two planes, facilitating the construction of three-dimensional structures. Construction toy sets incorporating these features are sold commercially under the trademark K'NEX by K'nex Industries, Inc., Hatfield, Pa.

SUMMARY OF THE INVENTION

The present invention is directed to a novel and improved form of connector element, which is compatible with the existing K'NEX multi-part construction toy system, wherein a connector element is formed of two parts, hinged together for pivotal movement. Among other advantages, the hinged connector element facilitates the initial construction of three-dimensional structures entirely or in part in two-dimensional form. Thus, as set forth in co-pending application Ser. No. 11/049,809, filed Feb. 3, 2005, it is advantageous at times to assemble a structure in two-dimensional form directly over a full-size, two-dimensional plan, such that a child can place parts directly on top of a full-size illustration thereof on the underlying two-dimensional plan. After completing a two-dimensional assembly in this manner, portions of it can be easily pivoted out of the initial assembly plane, by means of the hinged connector of the invention, in order to convert the initial two-dimensional structure to a three-dimensional form. The hinged connector elements also enable structures to accommodate special forms of pivotal motion between adjacent portions of an assembled structure.

In a particularly preferred embodiment of the invention, a connector element, comprised of two hingedly connected parts, is formed with eight rod-engaging sockets. Four sockets are provided on each of the hinged connector parts, with each socket being disposed at an angle of 45 degrees to its neighbor. The arrangement is such that the hinged connector is arranged with its sections in a common plane, the connector corresponds generally in size and function to the basic eight-socket connector of a standard K'NEX set, as illustrated in the before-mentioned Glickman U.S. Pat. No. 5,061,219. In the device of the present invention, however, the two connector parts can be disposed at any angle between zero and 90 degrees in either direction (180 degrees overall pivoting action). Although the preferred connector element described herein is illustrated as being formed with eight sockets, it will be understood and will become evident that pivoted connector elements according to the invention may be formed with a different number of rod-engaging sockets, if desired.

To particular advantage, the connector element of the invention is designed so that each of the two parts forming the assembled connector is of identical construction, such that any two connector half sections can be joined together to form an assembled, pivoted connector element. To this end, each of the connector half sections is provided along one edge thereof with one male hinge element and one female hinge element, with the two hinge elements being axially aligned. The female hinge elements preferably are in the form of open-sided cylinders, with cylindrically contoured walls extending over an angle somewhat in excess of 180 degrees. This allows the female hinge elements to be easily joined with the male hinge elements with a snap-together action.

For a more complete understanding of the above and other features and advantages of the invention, reference should be made to the following detailed description of a preferred embodiment, and to the accompanying drawings.

DESCRIPTION OF A PREFERRED EMBODIMENT

Figure 1:
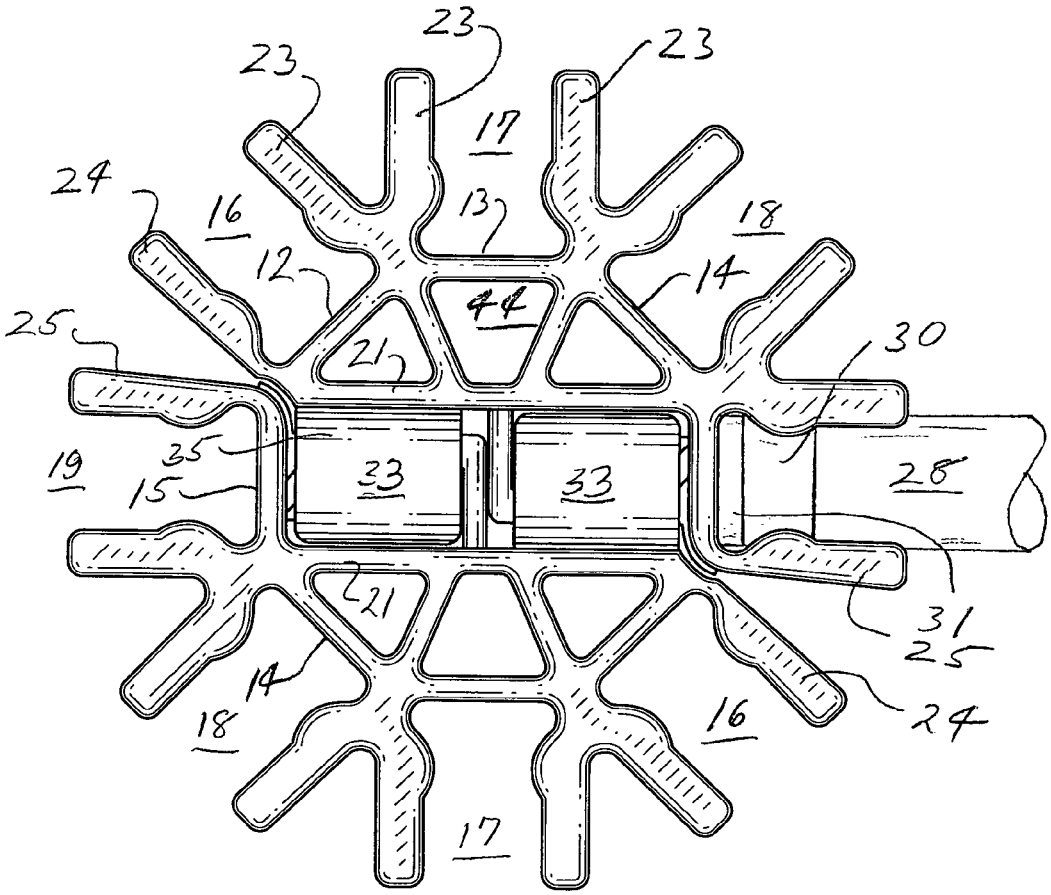
FIG. 1 is a front elevational view of an assembled, two-part hinged connector element according to the invention.

Referring now to the drawings, and initially to FIGS. 4-9 thereof, the reference numeral 10 designates generally a connector half section constructed in accordance with the invention. The half section 10 includes a body portion 11 which forms four sides of an octagon comprised of walls 12-15. The four walls 12-15 form bottom walls of a plurality of rod-engaging sockets 16-19 respectively, which extend radially outward from a common center point 20. A base wall 21 connects the opposite ends of the octagon walls 12-15, extending parallel to a hinge axis 22 which extends through the common center point 20.

The connector half section 10 is formed with a plurality of rod-gripping arms 23-25, with arms 24, 25 being located at the opposite end extremities of the connector section. Functionally, the gripping arms are the same as set forth in the Glickman U.S. Pat. No. 5,061,219. In this respect, each of the gripping arms 23, 25 of a socket-forming pair includes a groove 26 extending along the radial axis of the socket. Laterally outer portions of the gripping arms are provided with angled lead-in surfaces 27 to facilitate a lateral snap-in assembly of a rod element 28 (FIG. 1). Each of the gripping arms 23-25 is provided with an inwardly projecting rib 29 extending transversely across the width of the socket, for engagement with a correspondingly contoured annular groove 30 in the rod. An end flange 31 of the rod seats in a recess 32 in the bottom of each socket, preferably urged inwardly against the bottom wall 12-15 by reason of cooperation between the transverse projections 29 and the annular groove 30.

Figure 4:
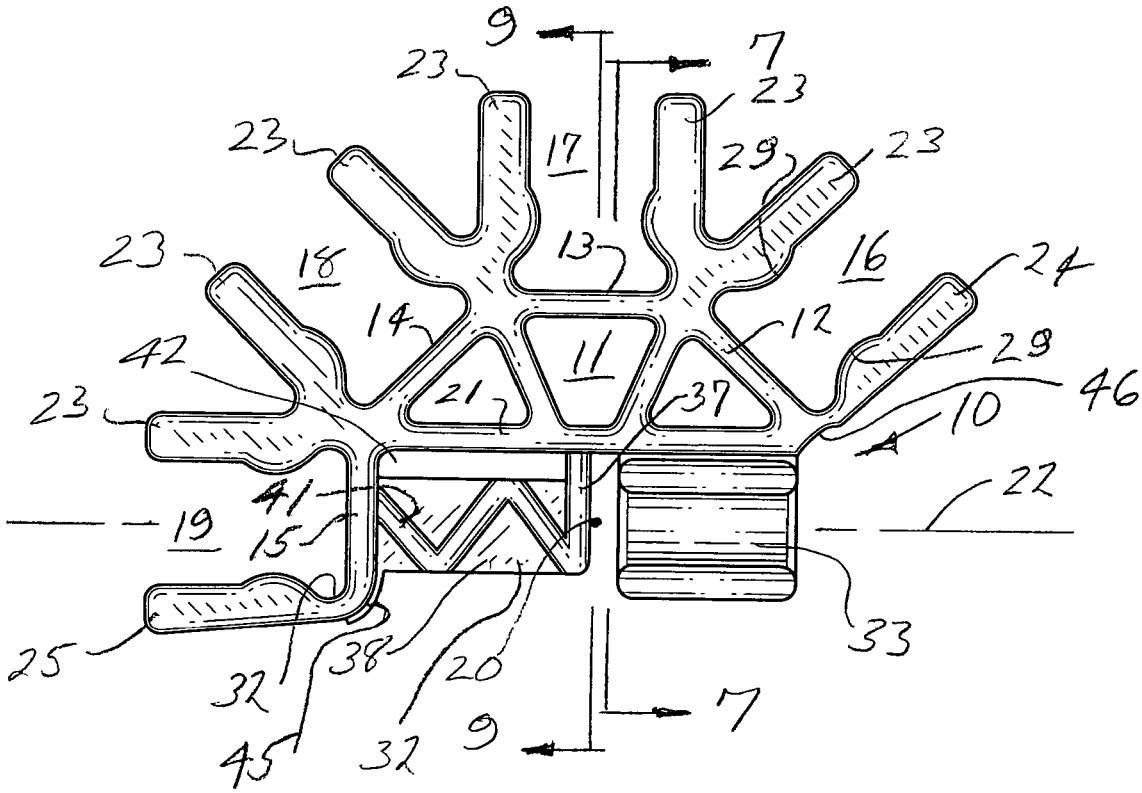
FIG. 4 is a back elevational view of a single connector half section constructed according to the invention.
Figure 5:
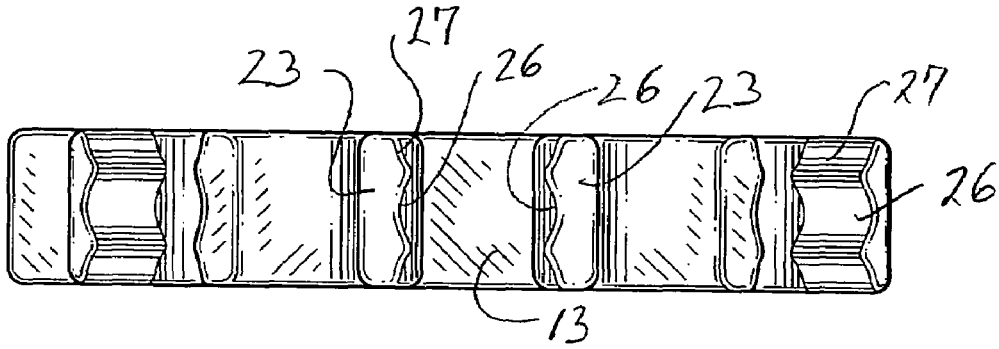
FIGS. 5 and 6 are top and bottom plan views respectively of the connector half section of FIG. 4.
Figure 6:
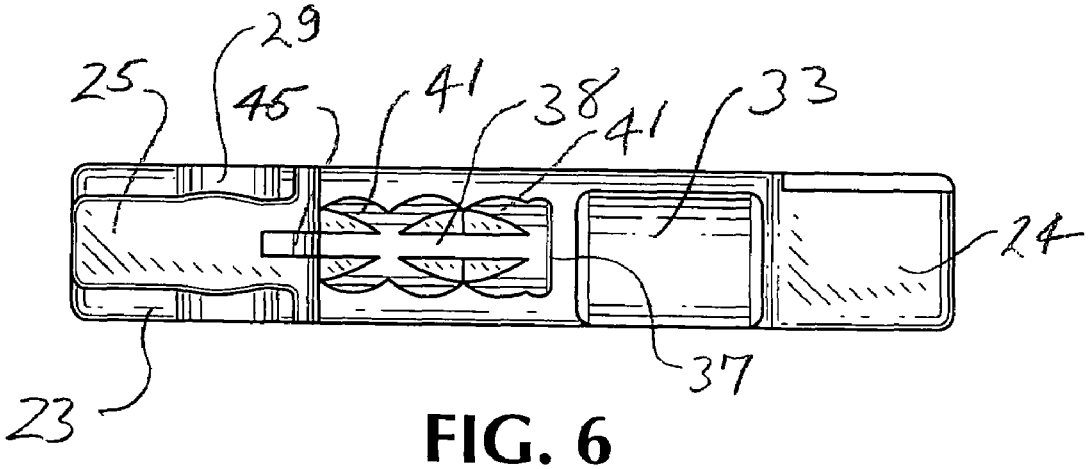
Figure 7:
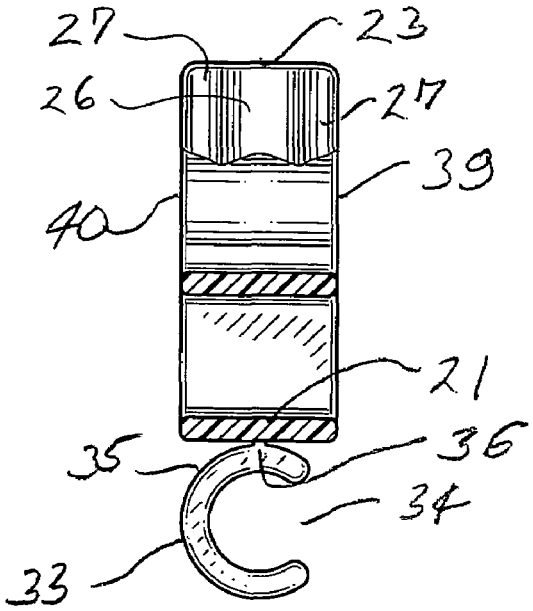
FIG. 7 is a cross sectional view as taken generally on line 7-7 of FIG. 4.
Figure 8:
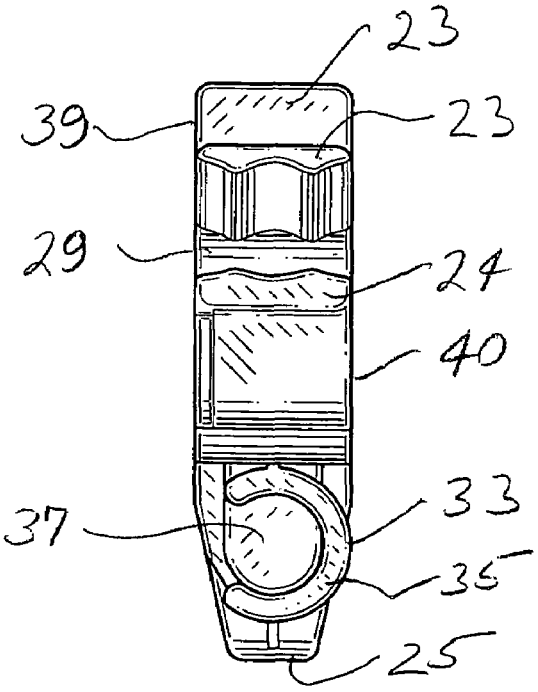
FIG. 8 is an end elevational view of the connector half section of FIG. 4.

In the illustrated and preferred embodiment of the invention, each of the connector half sections 10 is provided with one male hinge element 32 and one female hinge element 33. The female hinge element, shown in profile in FIGS. 7 and 8, preferably is in the form of an open-sided cylinder, with the open side 34 thereof facing to one side of the half section 10. The wall 35 of the cylinder is integrally attached at 36 to the base wall 21 of the connector half section, as shown in FIGS. 7 and 8. The cylindrical wall 35 is aligned along the axis 22, which forms the hinge axis of a pair of assembled half sections. As shown in FIG. 4, the female hinge element 33 is located at one end of the base wall 21, which may sometimes be referred to as the diametral edge of the half section.

The male hinge element 32 is located at the opposite end of the base wall 21, axially aligned with the female hinge element 33 but spaced slightly therefrom. The male hinge element is anchored to the body of the half section by an end plate 37 at one end, and by the socket bottom wall 15, at the other end.

To advantage, the male hinge element 32 has an effectively cylindrical cross section corresponding to the internal cylindrical cross section of the female hinge element 33. In the specifically illustrated form of the invention, the male hinge element comprises a central planar core 38, preferably aligned with planes formed by opposite side surfaces 39, 40 of a connector half section.

If desired, the male hinge part 32 may be produced in the form of a solid cylinder. However, both weight and material can be saved by forming the male hinge element as being "effectively cylindrical" rather than in the form of a solid cylinder. To this end, the hinge element 32 is formed with a plurality of thin spacer elements 41 extending at an angle along the central panel 38. Viewed from the side, as in FIGS. 2 and 4, the spacer elements 41 appear in a zigzag fashion. As viewed axially, however, the spacer elements 41 would define a circular outline corresponding substantially to the internal diameter of the female hinge element 33.

As is evident in FIG. 4, a space 42 is provided between the core panel 38 of the male hinge element and the base wall 21. The length and width of the space 42 is such that it can closely receive the side wall 35 of a female hinge element 33 of another connector half section, in order to accommodate the desired hinging action.

Figure 2:
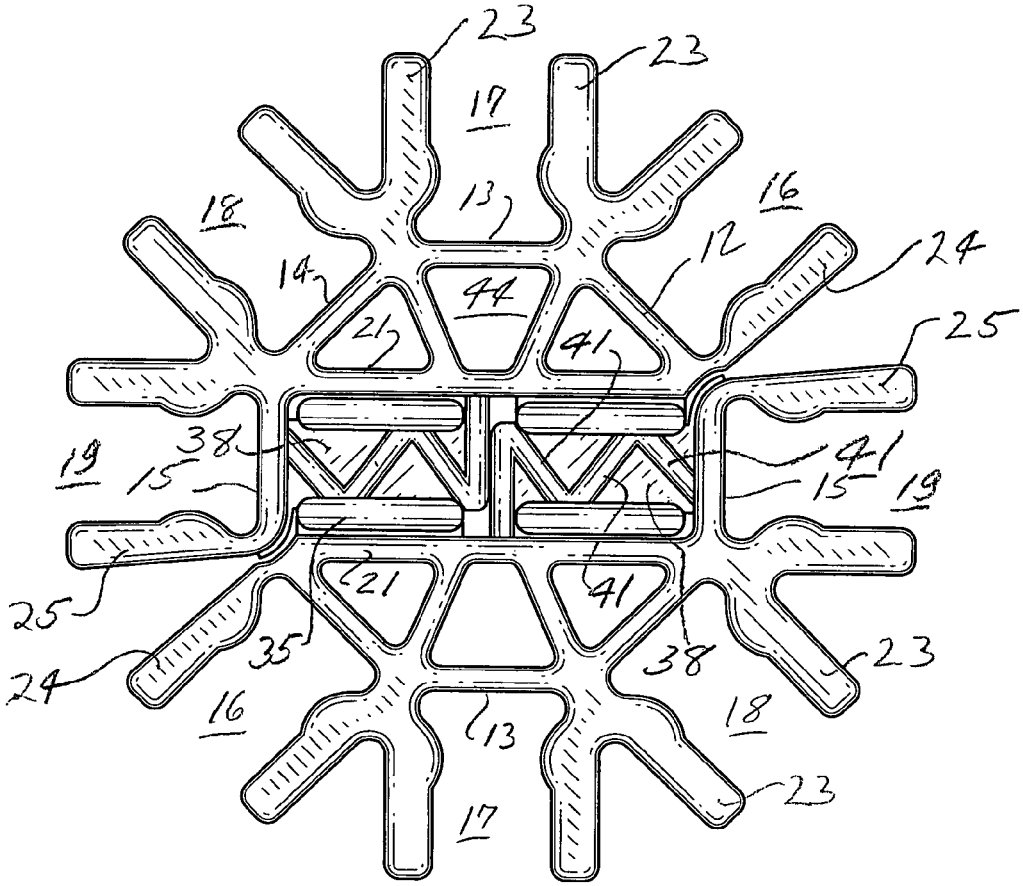
FIG. 2 is a back elevational view of the assembled connector of FIG. 1.
Figure 3:
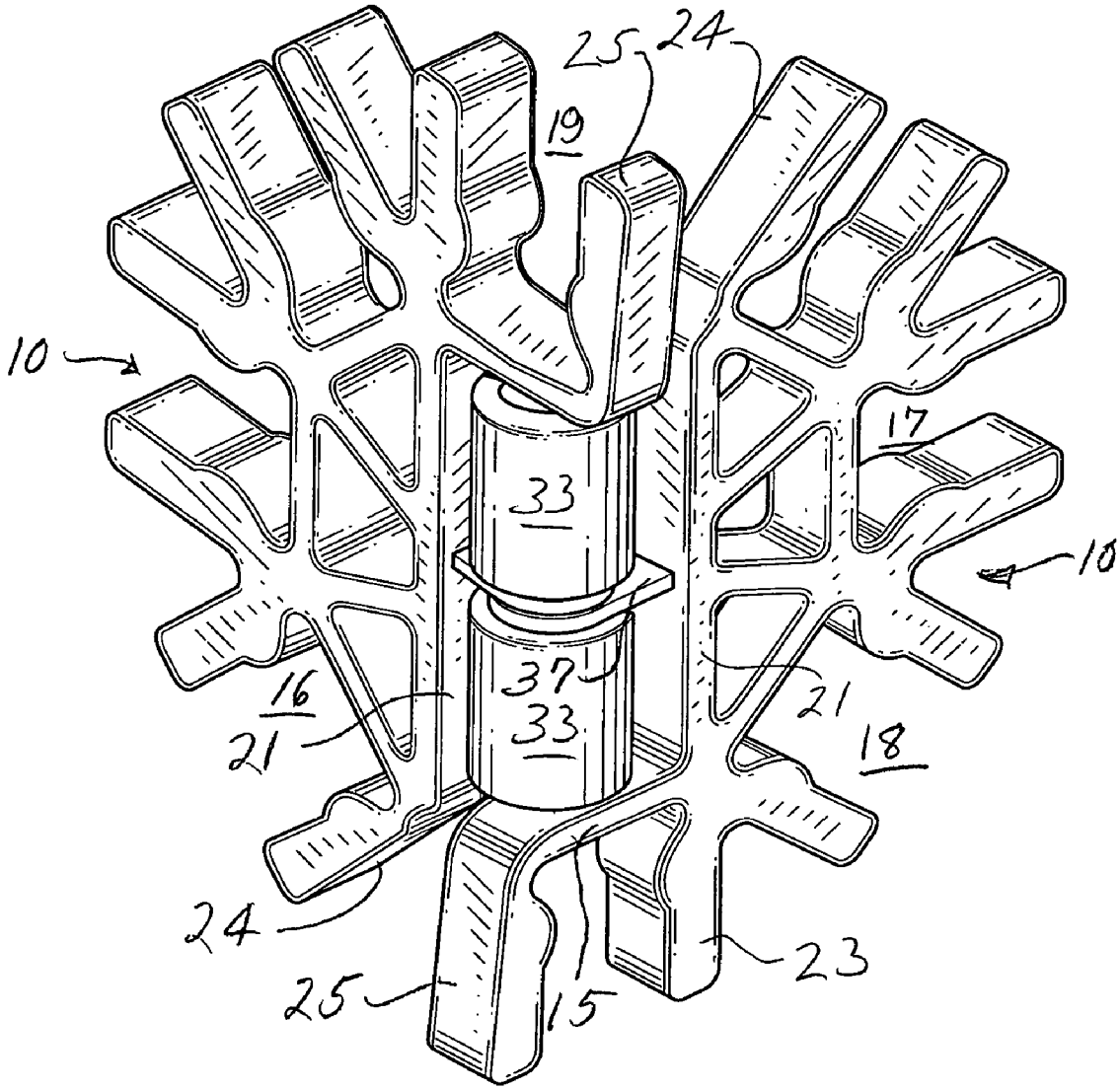
FIG. 3 is a perspective view of the connector of FIGS. 1 and 2, illustrating the two-part connector with its individual half sections disposed at an angle of 90 degrees.

In accordance with one aspect of the invention, a pair of identical half sections, as shown in FIG. 4, may be connected together to form a hinged connector element 44, as shown in FIGS. 1 and 2. The assembly is accomplished by orienting the two half sections with the principal planes thereof more or less at right angles, and with the axis of one half section tilted slightly with respect to the other (twist angle). This enables the open sides of the two cylindrically contoured female hinge elements 33 to be forced over the respective male elements 32 with a snap-together action. In this respect, in the illustrated form of the invention, the cylindrical wall 35 of the female hinge element advantageously encompasses an included angle of about 270 degrees. This requires the side openings 34 of the female hinge elements to be forced open in order to fit over the effectively cylindrically contoured elements 32. Once assembled, the two connector half sections are, for all practical purposes, permanently assembled, although they may in fact be disassembled by pivoting the two half sections at an angle of around 90 degrees and imparting a twist action between the two halves. The disassembly is essentially the reverse of the assembly operation. It will be noted in FIGS. 1 and 2 that, in the assembled form of two connector half sections, the female hinge elements 33 of each half section face in the same direction. The assembled half sections have a range of pivoting action of 180 degrees, or 90 degrees on either side of the coplanar configuration shown in FIGS. 1 and 2.

With reference to FIGS. 1 and 2, it will be noted that the rod-engaging sockets 19 at one end of each half section are aligned axially with respect to the hinge elements 32, 33. Accordingly, the hinging action of the respective half sections, one with respect to the other, will take place about the axes of any rods engaged by these sockets.

In the illustrated form of the invention, the connector elements are intended for use in connection with a standard K'NEX multi-part construction toy set, and are dimensioned accordingly. It will be understood, however, that specific dimensions referred herein are for illustrated purposes only, and are not in any way limiting of the invention. For a standard K'NEX construction toy set, the combined connector 44 (FIGS. 1 and 2) typically may have a thickness on the order of ¼ inch. The two-part connector element is more or less circular in its overall configuration, with an overall diameter of around 1.5 inches. The two half sections, accordingly, are formed with somewhat of a semi-circular configuration, for an assembled connector of generally circular configuration, as will be understood.

Figure 9:
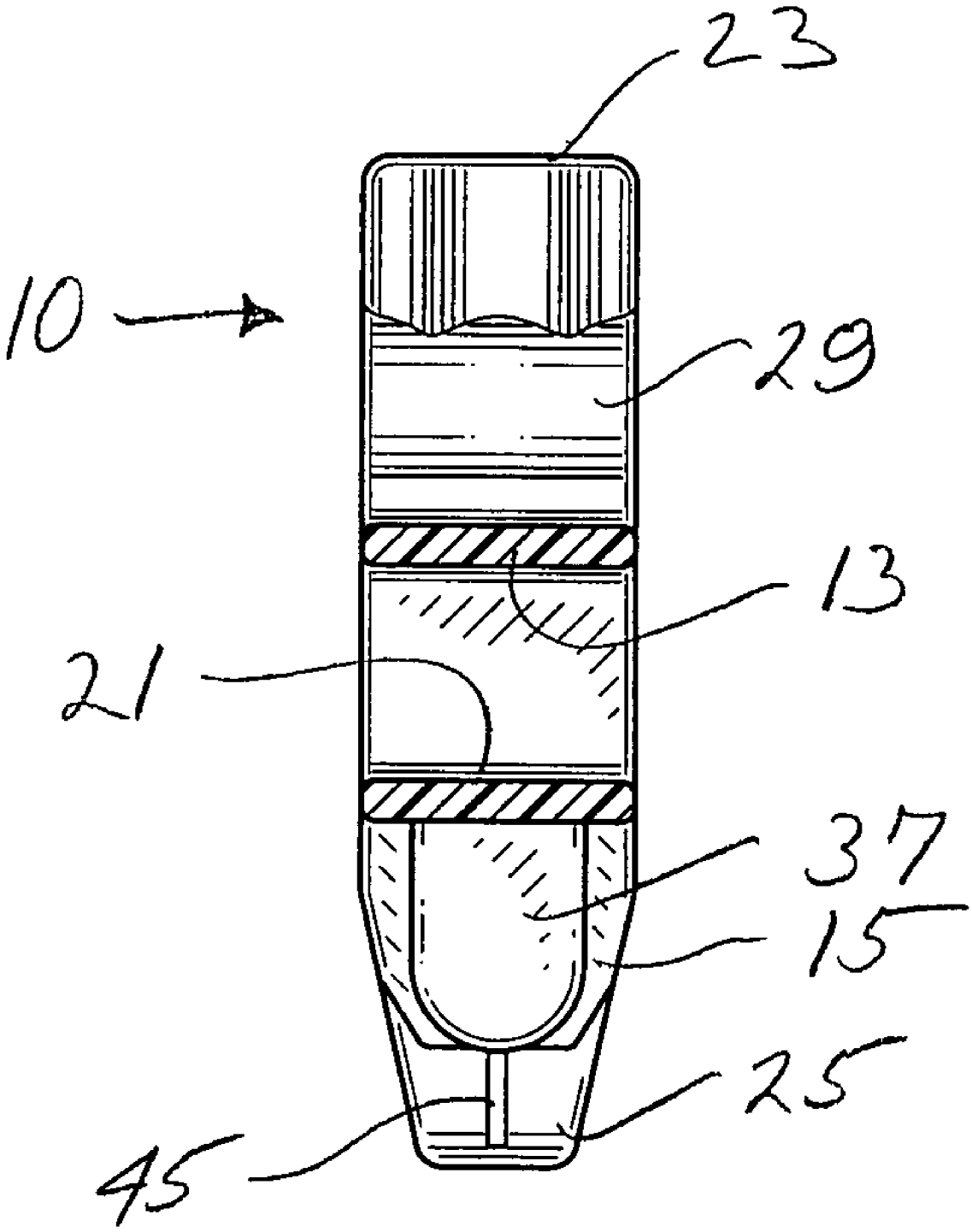
FIG. 9 is a cross sectional view as taken generally on line 9-9 of FIG. 4.

To accommodate pivoting action between two connected half sections 10, about the pivot axis 22, the gripping arm 25, at the outer side of the axially aligned rod-engaging socket 19, is formed of a narrower width than the several rod-engaging arms 23. This can be seen in FIGS. 8 and 9. The bottom walls 15 of the sockets 19 likewise are tapered from the rod-engaging arm 23 on one side thereof to the arm 25 on the opposite side thereof. This narrower configuration of the rod gripping arms 25 and the tapered bottom walls 15 allows the connected half sections to rotate without interference between the base of the rod gripping arm 24 of one half section with the rod gripping element 25 of the other. At its narrowest point, along its outside edges, the width of the gripping arm 25 may be approximately half the overall thickness of the connector element section. To impart additional gripping strength to the narrowed rod gripping arm 25, a reinforcing rib 45 may be provided at the base thereof, as shown in FIGS. 4 and 9. The gripping arm 24, at the opposite end of the connector half section, is recessed slightly at 46 (FIG. 4) to clear the reinforcing rib 45 of an opposite half section, when the two are connected for rotation.

Preferably, the connector half sections 10 are formed by injection molding, with a high strength plastic material. One preferred material is "Celcon" acetal copolymer, marketed by Ticona, a Division of Celanese.

The connector element of the invention extends the variety of structures that can be assembled and used with a K'NEX rod and connector construction toy set. Among other things, the pivoting connector element enables structures to be assembled with adjacent portions at various angles. Moreover, in certain cases, it may be desirable to assemble a three-dimensional structure, or portions of a three-dimensional structure, in two-dimensional form, directly upon a full-size plan, and thereafter convert the two-dimensional structure to a three-dimensional form. The pivoting connector element is extremely useful in such assembly procedures, inasmuch as it allows a portion of a two-dimensional structure to be simply pivoted into a three-dimensional configuration after initial assembly.

The pivoting connector of the invention is easily assembled from using two identical connector half sections, which are easily snapped together to form a semi-permanent connection. Once assembled by the user, a hinged connector typically will remain in its assembled condition, although it may easily be disassembled if desired.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

The invention claimed is:

1. A connector element for a rod and connector construction toy set of the type enabling a lateral snap-in assembly of rod elements into sockets of the connector, which comprises (a) first and second connector half sections, each having height and width dimensions, (b) said half sections having front and back sides of generally flat form defining a thickness less than said height or width dimensions, (c) each of said half sections having a plurality of pairs of angularly related, outwardly extending rod-gripping arms defining a plurality of rod-engaging sockets, (d) each of said half sections having, on one edge thereof, male and female hinge elements aligned along a connector hinge axis extending parallel to said one edge and positioned centrally between said front and back sides, (e) said male hinge elements being effectively of generally cylindrical configuration and having axes coincident with said hinge axis, (f) said female hinge elements being generally in the form of an open-sided hollow cylinder having axes coincident with said hinge axis and each comprising a generally cylindrically contoured wall section with portions thereof extending over an arc of greater than 180 degrees and having an open side with portions thereof extending over an arc of less than 180 degrees, (g) a pair of said half sections being of substantially identical construction with respect to said hinge elements and being mutually engageable by a snap-together assembly of the female hinge element of each half section with the male hinge element of the other half section, (h) said pair of half sections, when so mutually engaged, being pivotable with respect to each other from a position of planar alignment to positions of angular relation.

2. A connector element according to claim 1, wherein, (a) the open side of each of the female hinge elements of said connector half sections faces generally at right angles to the front and back sides of said of said half sections.

3. A connector element according to claim 2, wherein (a) said connector half sections are configured such that, when said half sections are joined, the open sides of said female hinge elements of both half sections face in the same direction, (b) said connector half sections being adapted for snap-together assembly by initially engaging central portions of said half sections, along the respective diametral edges thereof, while disposing said half sections with principal planes thereof disposed at an angle and with the hinge axes of the half sections disposed at a twist angle to allow engagement of the female hinge elements with respective male hinge elements of an opposite half section.

4. A connector element according to claim 3, wherein (a) each connector half section is formed with one rod-engaging socket located at an end of said diametral edge and with an axis of said socket being generally aligned with axes of said hinge elements.

5. A connector element according to claim 4, wherein (a) each connector half section has one or more additional rod-engaging sockets disposed at an angle of about 45 degrees or a multiple thereof from an adjacent rod-engaging socket.

6. A connector element according to claim 3, wherein, (a) an open space is provided in an axial space between adjacent ends of said male and female hinge elements to accommodate engagement and disengagement of a each pair of male and female hinge elements while said half sections are disposed at said twist angle.

7. A connector element according to claim 1, wherein (a) each said male hinge element comprises a central portion of non-cylindrical cross section, and (b) a plurality of thin spacer elements extending from said central portion and having external surface portions providing an effectively cylindrical cross sectional configuration to said male hinge elements.

8. A connector element according to claim 7, wherein (a) said central portion of non-cylindrical cross section comprises a flat panel portion containing the hinge axis of said male hinge element, and (b) said spacer elements extends from opposite sides of said flat panel portion.

9. A connector element according to claim 8, wherein (a) said spacer elements are disposed at an angle with respect to the hinge axis of said male hinge element.

10. A connector element according to claim 5, wherein (a) each of said connector half sections is formed with four rod-engaging sockets, each disposed at an angle of 45 degrees with respect to its neighboring sockets.

11. A connector element according to claim 4, wherein (a) said axially aligned rod engaging sockets are formed by first and second spaced apart rod-gripping arms, (b) said first rod gripping arm being oriented generally parallel to a hinge axis of said connector element and being positioned on a connector half section on the side of said hinge axis nearest to an adjacent, connected connector half section, and (c) the width of said first rod-gripping arm being less than the width of said connector half sections to accommodate pivoting action of said connector half sections.

12. A connector element according to claim 1, wherein (a) said male hinge elements are positioned in spaced parallel relation to said one edge, whereby the cylindrical contoured wall of a female hinge element engaged therewith passes between said male hinge element and said one edge.

* * * * *